United States Patent [19]

Raymont et al.

[11] Patent Number: 4,754,247

[45] Date of Patent: Jun. 28, 1988

[54] MOLDED CASE CIRCUIT BREAKER ACCESSORY ENCLOSURE

[75] Inventors: Paul A. Raymont, Avon; James M. Mitsch, West Hartford; James I. Smith, Avon; Robert A. Morris, Burlington; Irenaeus S. Panus, New Britain; Lloyd G. Palmer, Bristol, all of Conn.

[73] Assignee: General Electric Company, New York, N.Y.

[21] Appl. No.: 61,244

[22] Filed: Jun. 12, 1987

[51] Int. Cl.[4] ..... H01H 9/02; H01H 13/04

[52] U.S. Cl. ..... 335/202; 200/303

[58] Field of Search ..... 335/202, 132, 176, 42, 335/43, 44, 45, 6–10; 200/303, 304, 305, 309

[56] References Cited

U.S. PATENT DOCUMENTS

| | | | |
|---|---|---|---|
| 3,708,771 | 1/1973 | Schreckenberg | 335/176 |
| 4,038,618 | 7/1977 | Gryctko | 335/43 |
| 4,297,663 | 10/1981 | Seymour et al. | 335/20 |
| 4,589,052 | 5/1986 | Dougherty | 361/94 |
| 4,622,444 | 11/1986 | Kandatsu | 200/303 |
| 4,649,455 | 3/1987 | Scott | 361/93 |

*Primary Examiner*—E. A. Goldberg
*Assistant Examiner*—Lincoln Donovan
*Attorney, Agent, or Firm*—Richard A. Menelly; Walter C. Bernkopf; Fred Jacob

[57] ABSTRACT

An integrated protection unit is a circuit breaker which includes basic overcurrent protection facility along with selective electrical accessories. A molded plastic accessory access cover secured to the integrated protection unit cover protects the accessory components from the environment. The accessory cover includes means for cooperating with a load center or panelboard circuit breaker enclosure to prevent access to the accessory components within the load center or panelboard interior.

25 Claims, 5 Drawing Sheets

MOLDED CASE CIRCUIT BREAKER ACCESSORY ENCLOSURE

BACKGROUND OF THE INVENTION

The trend in the circuit protection industry is currently toward complete circuit protection which is accomplished by the addition of supplemental protection apparatus to standard overcurrent protective devices, such as molded case circuit breakers. In the past, when such auxiliary protection apparatus or other circuit breaker accessories were combined with a standard circuit breaker, the accessories were usually custom-installed at the point of manufacture. The combined protective device, when later installed in the field, could not be externally accessed for inspection, replacement or repair without destroying the integrity of the circuit breaker interior. An example of one such factory installed circuit breaker accessory is found in U.S. Pat. No. 4,297,663 entitled "Circuit Breaker Accessories Packaged in a Standardized Molded Case", which patent is incorporated herein for reference purposes.

A more recent example of a circuit breaker including additional accessories is found in U.S. Pat. No. 4,622,444 entitled "Circuit Breaker Housing and Attachment Box" which allows the accessories to be field-installed within the circuit breaker without interfering with the integrity of the circuit breaker internal components. This is accomplished by mounting the accessories within a recess formed in the circuit breaker enclosure cover.

An electronic trip actuator which is mounted within the circuit breaker enclosure is described within U.S. patent application Ser. No. 862,929 filed May 14, 1986 and entitled "Trip Actuator for Molded Case Circuit Breakers". The circuit breaker actuator responds to trip signals generated by an electronic trip unit completely contained within a semi-conductor chip such as that described within U.S. Pat. No. 4,589,052. The development of a combined trip actuator for both overcurrent protection as well as accessory function is found within U.S. patent application Ser. No. 882,989 filed July 7, 1986 and entitled "Combined Trip Unit and Accessory Module for Electronic Trip Circuit Breakers". The aforementioned U.S. Patent Applications and U.S. Patent which represent the advanced state of the art of circuit protection devices are incorporated herein for reference purposes.

When one of such accessories is field-installed within the integrated protection unit cover, it is important that the accessory components are not removed or tampered with once the integrated protection unit is installed within an electric circuit. One purpose of the instant invention accordingly, is to provide field access facility to an integrated protection unit to allow selected accessory features to be readily installed before the integrated protection unit is connected within an electric circuit while later preventing access to such accessory components when the integrated protection unit is connected within the electric circuit.

SUMMARY OF THE INVENTION

An integrated protection unit which includes overcurrent protection along with auxiliary accessory function, contains an access cover for the selected accessory components, to allow field installation of the accessory components prior to connecting the integrated protection unit within an electric circuit. Means are provided on the accessory cover to prevent access to the accessory components when the integrated protection unit is operatively connected within an electric circuit. The means include extension tabs formed within one end of the accessory cover and arranged for cooperating with the face plate of the load center or panelboard enclosure within which the integrated protection unit is installed. The access means comprise a pair of planar plastic doors connected with the accessory cover by means of integrally-formed "living hinges". Alternative means for preventing access to the accessory components comprise latches integrally-formed at the ends of the accessory doors which latches require a special tool for unlatching the doors.

DESCRIPTION OF THE PREFERRED EMBODIMENT

Figure 1:
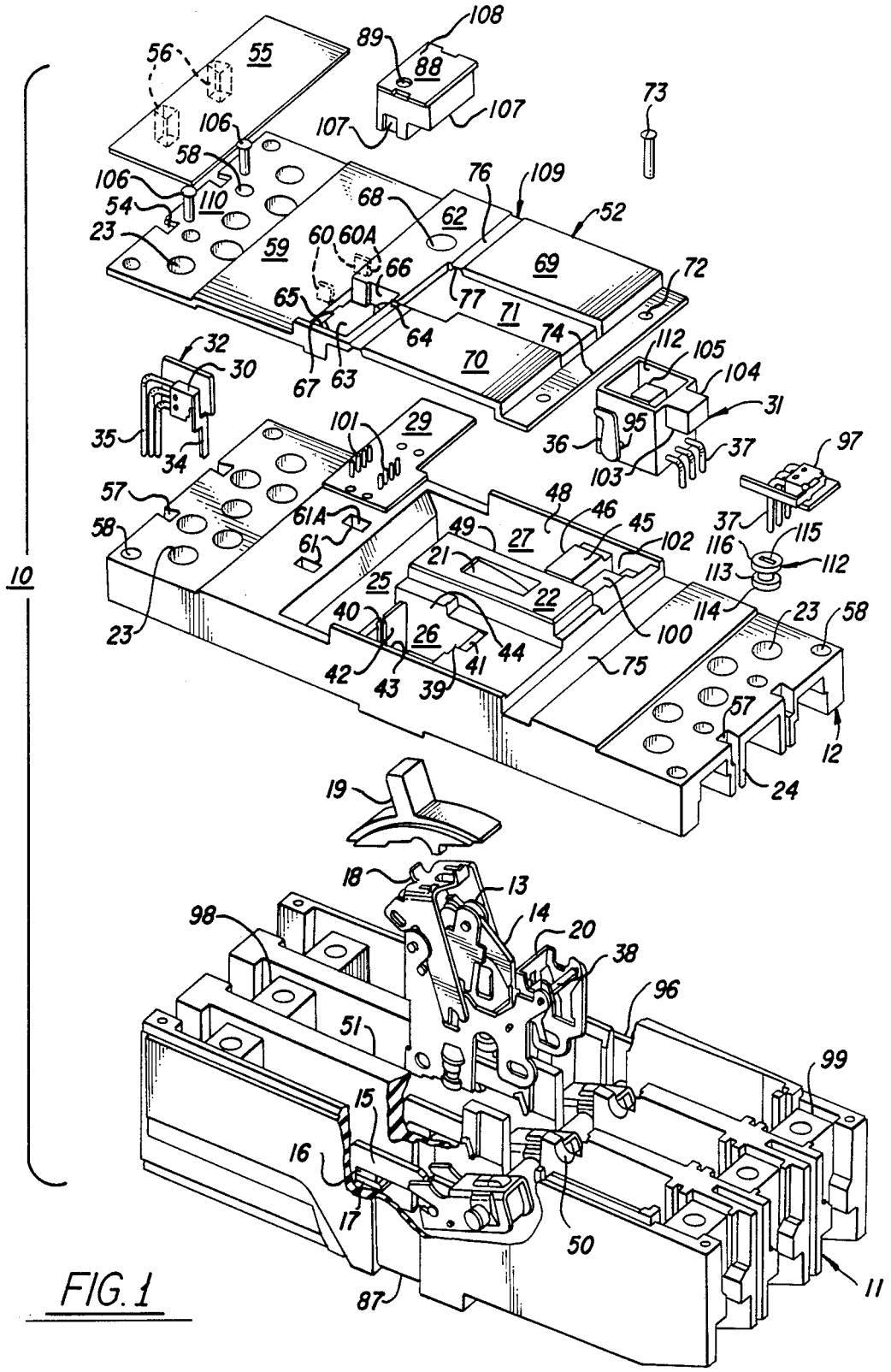
FIG. 1 is an exploded top perspective view of the integrated protection unit according to the invention.
Figure 4:
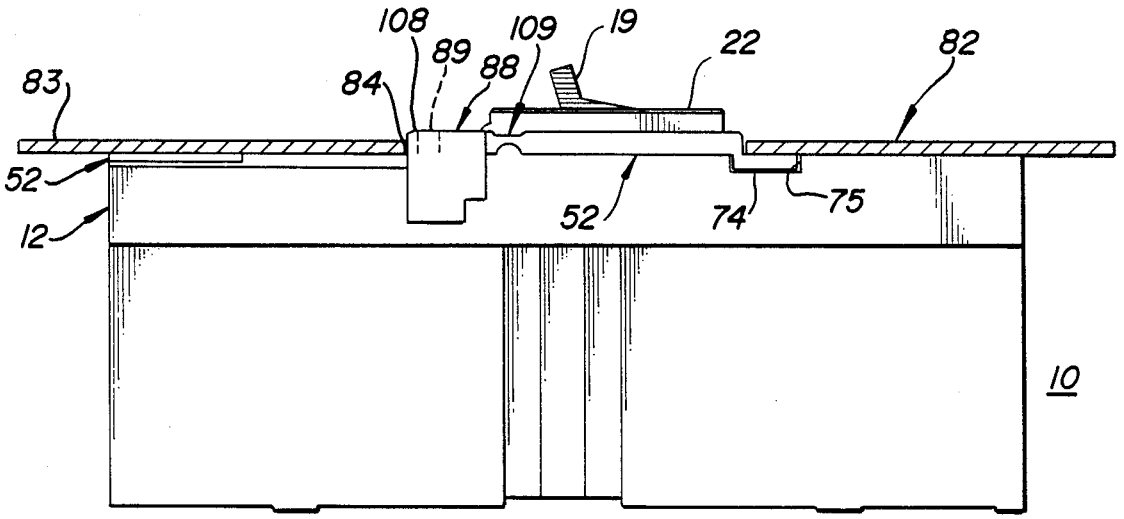
FIG. 4 is a side view, in partial section of the arrangement depicted in FIG. 3 as viewed in the 4—4 plane.

An integrated protection unit circuit breaker 10 is shown in FIG. 1 prior to assembly at the point of manufacture. The integrated protection unit circuit breaker or "integrated circuit breaker" is defined herein as a molded case circuit breaker having an electronic trip unit for overcurrent protection and which also includes at least one auxiliary electrical accessory. The accessories commonly employed with molded case circuit breakers include auxiliary switches, shunt trip elements, and undervoltage sensing units. The integrated circuit breaker case 11 supports an operating mechanism generally depicted at 13 which includes an operating cradle 14 for restraining a movable contact carrier 15 and movable contact 16 from separating away from a fixed contact 17 against the urgence of a pair of powerful operating springs (not shown) mounted on both sides of the operating mechanism. One end of the operating cradle 14 is retained within a latch 20 which allows the movable contact carrier 15 to be moved between its closed and open positions by manual operation of the handle yoke 18 operatively connected with the handle 19. A trip bar 38 arranged next to a trip lever 36 extending from a trip actuator 31 disengages the latch 20 from the operating cradle 14 to allow the operating mechanism 13 to rapidly drive the movable contact carrier 15 to its tripped position. A good description of the operating mechanism 13 is found within U.S. patent application Ser. No. 817,213 filed Jan. 8, 1986 entitled "Interchangeable Mechanism for Molded Case Circuit Breaker", which application is incorporated herein for purposes of reference. An integrated circuit breaker cover 12 is attached to the case by the insertion of rivets or screws (not shown) through corresponding openings 58 formed within opposite ends of the integrated circuit breaker cover. When the cover is attached to the case, the downwardly extending walls 24 align with corresponding phase barrier walls 51 integrally formed within the case to electrically isolate the components contained within the separate phases when the integrated circuit breaker is connected within a multi-phase electric circuit. As described within aforementioned U.S. patent application Ser. No. 882,989 a slot 50 formed within one of the phase barrier walls 51 supports the trip actuator shaft 95 and allows the trip lever 36 to operatively react with the trip bar 38 to trip the breaker, as described earlier. The wires 37 extending from the bottom of the trip actuator electrically connect with the electronic trip unit circuit contained within the printed wire board 29. The printed wire board 29 is mounted within an elongated trip unit recess 25 formed within the integrated circuit breaker cover. An accessory recess 26 formed ahead of the trip unit recess 25 is defined by a pair of opposing side walls 43, 44 and front and rear walls 41, 42 as indicated. A pair of vertical slots 39, 40 which are formed in the front and rear walls receive the sides of an insulated support plate 32 which carries an accessory switch 30 from which a switch lever 34 downwardly extends. The auxiliary switch is similar to that described within aforementioned U.S. Pat. No. 4,297,663. The wires 35 extending from the auxiliary switch pass through an opening (not shown) formed in the bottom of the accessory recess 26 and then along the wiring access slots 87 formed on one side of the integrated circuit breaker case 11. Similar wiring access slots 96 are formed on the opposite side of the integrated circuit breaker case to provide access for the wires 37 extending from the trip actuator 31. The trip actuator 31 is assembled within the trip actuator recess 27 formed within the integrated circuit breaker cover on the opposite side of the cover inner escutcheon 22 through which the operating handle slot 21 is formed. The actuator recess 27 is defined by a pair of opposing side walls 48, 49 and a front wall 46 as indicated. The bottom 103 of a projection 104 on the trip actuator is supported on the integrated circuit breaker cover by means of a support block 45 integrally formed within the cover. Access to the components 105 within the trip actuator for selecting various accessory options such as is described within the aforementioned U.S. patent application Ser. No. 862,929, is made through the open top portion 112. A shallow bell alarm recess 100 is formed ahead of the trip actuator recess 27 for containing a bell alarm 97 which is identical to the accessory switch 30 except for mounting in the horizontal plane. The lead wires 37 extend down through a slot 102 formed through the bottom of the integrated circuit breaker cover. Once the trip unit printed wiring board 29 is inserted within the trip unit recess 25 and the accessory cover 52 is attached to the integrated circuit breaker cover 12 by means of screws 106 and screw holes 58, a rating plug 88 is next inserted within the rating plug recess 63 consisting of front and rear walls 64, 65 and opposing side walls 66, 67 formed within the accessory cover 52. The rating plug is described within U.S. patent application Ser. No. 045,645 which application is incorporated herein for reference purposes. The rating plug is electrically connected with the trip unit printed wire board 29 by the insertion of a plurality of contacts 107 on the bottom of the rating plug within a corresponding plurality of contact connectors 101 extending from a top surface of the printed wiring board. When the rating plug is inserted within the rating plug recess, the top surface 108 of the rating plug is co-planar with a central region 62 on the accessory cover 52 as best seen in FIG. 4. A test jack opening 89, formed within the top surface of the rating plug, allows for external access to the rating plug circuit contained within the trip unit printed wiring board 29. A good description of the rating plug circuit is found within U.S. Pat. No. 4,649,455, which patent is incorporated herein for purposes of reference. With the accessory cover 52 secured to the top surface of the integrated circuit breaker cover 12, the inner escutcheon 22 extends within an elongated opening 71 defined between the pair of accessory doors 69, 70 formed within the accessory cover 52. The accessory doors 69, 70 each include a "living" hinge, generally depicted at 109, which comprises a radial slot 77 extending along the bottom surface of the door at one end and a rectangular slot 76 extending along the top surface of the door coextensive with the radial slot. The slots 76, 77 provide a reduced thickness to the material in the vicinity of the hinge which allows the doors to pivot to and to remain in an open position. A pair of screw holes 72 formed within the accessory doors 69, 70 at the ends opposite from the living hinges allows the accessory cover to be attached to the integrated circuit breaker cover by means of screws 73. An angular offset tab 74 extending from the doors, fits within a corresponding offset slot 75 formed within the top surface of the integrated circuit breaker cover 12. The purpose of the offset angular tab 74 is to prevent the accessory doors 69, 70 from being opened to expose the components within the accessory recess 26 and the trip actuator recess 27 when the integrated circuit breaker is electrically connected within an electric circuit as will be discussed below in greater detail. A pair of posts 60 extending from the bottom surface of the stepped region 59 on the accessory cover 52 are received within a corresponding pair of slots 61 formed within the integrated circuit breaker cover to provide additional support to the accessory cover. Access to the load and line terminal lugs 98, 99 attached to the integrated circuit breaker case 11 is made by means of access holes 23 formed both through the integrated circuit breaker cover 12 and the accessory cover 52. The posts include offset tabs 60A integrally formed on the bottom which become trapped within slots 61A formed within the sides of slots 61 to tightly hold the accessory cover 52 against the integrated circuit breaker cover 12. A plastic lug cover 55 which also includes a pair of posts 56 extending from a bottom surface thereof, is next attached over the accessory cover 52 at the load end of the integrated circuit breaker to cover the line and load terminal access slots 23 with the posts 56 passing through a pair of clearance slots 54 in the accessory cover into a corresponding pair of attachment slots 57 integrally formed in the integrated circuit breaker cover 12. Alternatively, lug plugs 112 shown on the line end, can be inserted within the line and load terminal access slots 23 by inserting the ovalshaped lug base 114, stem 113 and cap 116 within the access hole and rotating the lug by inserting a small screwdriver within the tool access slot 115 formed within the cap. The locking arrangement between the lug plugs and the line and load terminal access holes will be described below in greater detail.

Figure 2A:
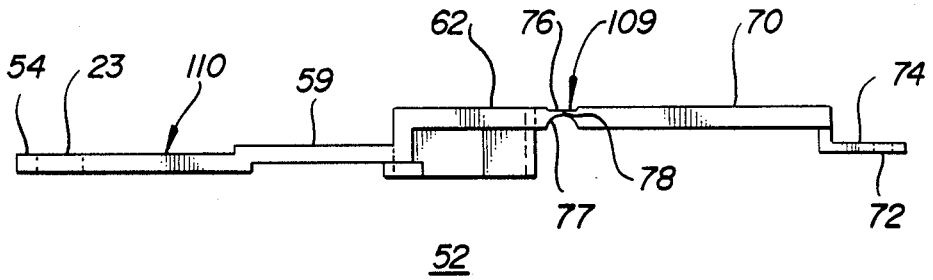
FIGS. 2A and 2B are side views of alternative embodiments of the accessory cover depicted in FIG. 1.

The accessory cover 52 shown in FIG. 1 is depicted in an enlarged side view at 52 in FIG. 2A. The living hinge 109 is shown with the rectangular slot 76 formed on the top surface and the radial slot 77 formed on the bottom surface opposite therefrom. A region of reduced thickness 78 results between the central region 62 of the accessory cover 52 and the accessory doors 69, 70 although only one such accessory door 70 is shown in FIG. 2A. The stepped region 59 is formed on the side of the central region 62 opposite the accessory door 70 and next to the lug cover region 110 through which the clearance slots 54 and terminal lug access openings 23 are formed. As described earlier, the screw holes 72 are formed through one end of each of the accessory doors 69, 70 and an offset tab 74 is integrally formed at the same end.

Figure 3:
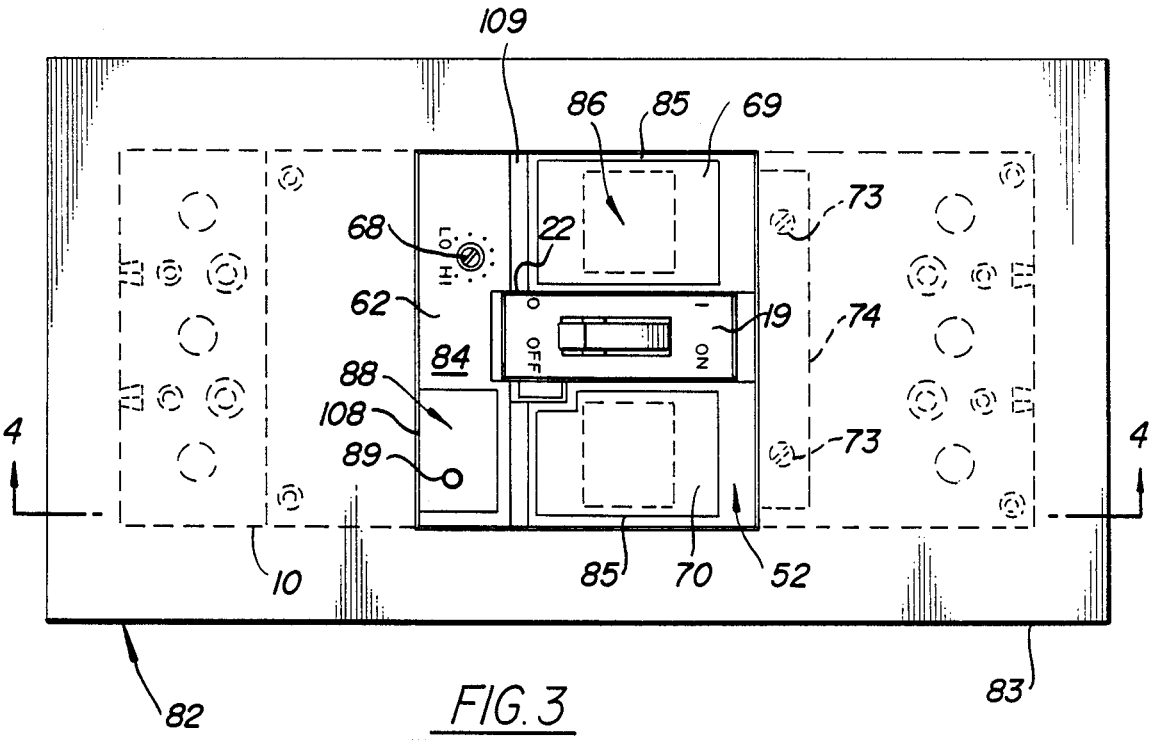
FIG. 3 a plan view of the integrated protection unit of FIG. 1 installed within a load center enclosure.

The trapping of the offset tabs 74, within an electrical circuit breaker enclosure, such as a load center or panelboard 82, is best seen by referring now to FIGS. 1, 3 and 4. The dead front or front plate 83 on the panelboard contains a rectangular opening 84 through which the circuit breaker inner escutcheon 22 extends for access to the handle 19. Also accessible through the dead front opening 84 are the accessory doors 69 and 70. A pair of name plates 85 are adhesively attached to each of the accessory doors with indicia, generally indicated at 86, to identify and describe the accessories contained therein. When the integrated circuit breaker 10 is installed within the panelboard 82, any attempt to open the accessory doors is prevented because the offset tabs 74 and screws 73 are now trapped beneath the dead front 83. Both the printed circuit board access opening 68, through the central region 62 of the accessory cover 52 and the test jack opening 89 on the top surface 108 of the rating plug 88 are accessible without having to remove the dead front 83. The offset tabs 74 are depicted in FIG. 4 within slots 75 formed within the integrated circuit breaker cover 12, with the living hinge 109 shown along side of the circuit breaker inner escutcheon 22.

Figure 2B:
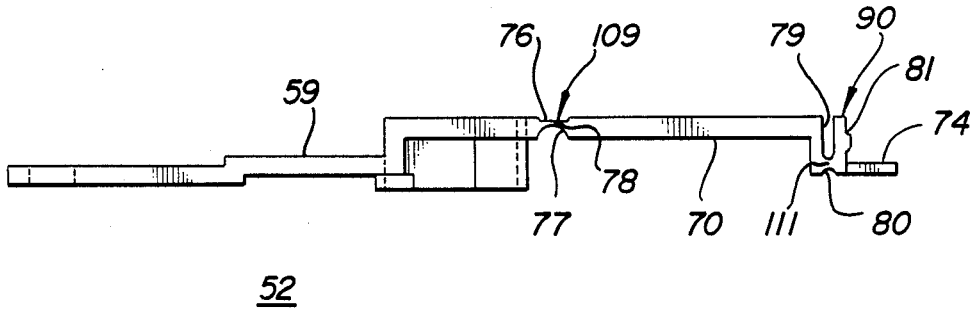
Figure 5:
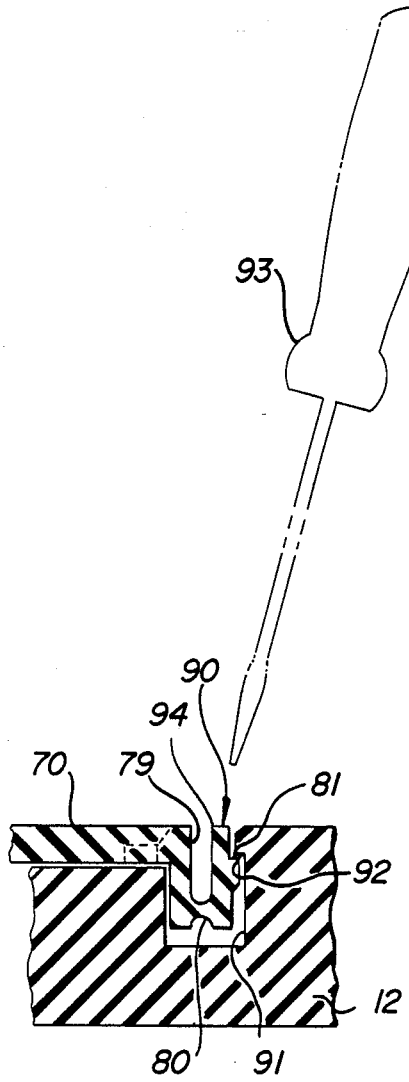
FIG. 5 is an enlarged side-sectional view of a part of an alternative latching arrangement for the accessory door depicted in FIG. 2B, in a latched condition.
Figure 6:
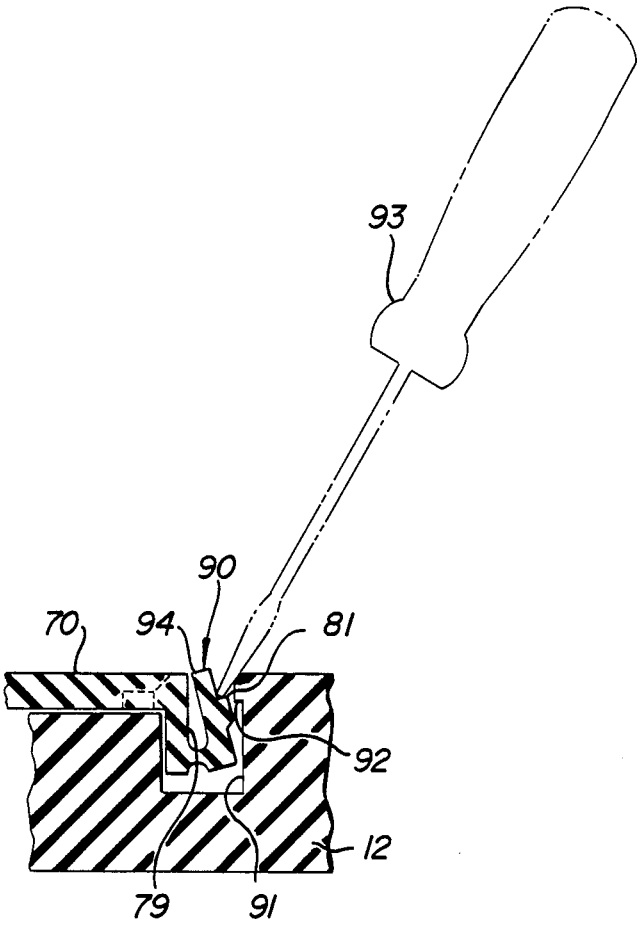
FIG. 6 is an enlarged side-sectional view of the part of the latching arrangement depicted in FIG. 5, in an unlatched condition.

An alternate arrangement of the accessory cover 52 is depicted in FIG. 2B with a similar living hinge 109 formed therein and with a similar offset tab 74 formed at the end of the accessory door 70. In place of the screw opening 72 shown in FIG. 2A, an integral latch 90 is formed at the end of the door inboard from the offset tab 74. The integral latch includes a deep radial groove 79 formed on the top surface of the accessory cover with a shallow radial groove 80 formed on the bottom surface opposite therefrom. A region of reduced thickness 111 is formed between the deep and shallow grooves to provide flexibility to the integral latch 90. The latch includes an integrally formed offset 81 which cooperates with an offset slot 92 formed within the integral circuit breaker cover 12 as best seen by referring now to FIGS. 5 and 6. The integral latch 90 is retained within the integral circuit breaker case by trapping the offset region 81 formed on the L-shaped end piece 94 and extending under the offset projection 92 integrally formed within the offset slot 91 in the integrated circuit breaker cover 12. To unlatch the accessory door 70 from the integral circuit breaker cover 12, a tool similar to a screw driver 93 shown in phantom in FIGS. 5 and 6, is inserted within the offset slot 91 to bend the L-shaped end piece 94 into the deep radial groove 79 which thereby allows the offset projection 81 to clear the offset projection 92 within the offset slot 91 as shown in FIG. 6.

Figure 7A:
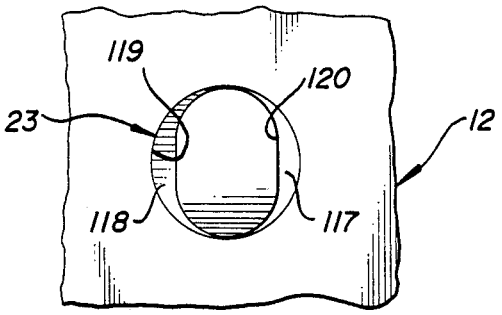
FIG. 7A is an enlarged plan view of the line and load terminal access holes depicted in FIG. 1.
Figure 7B:
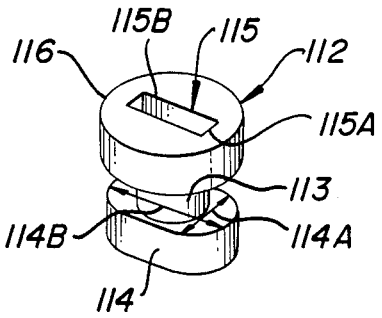
FIG. 7B is an enlarged top perspective view of the lug plug depicted in FIG. 1.
Figure 8A:
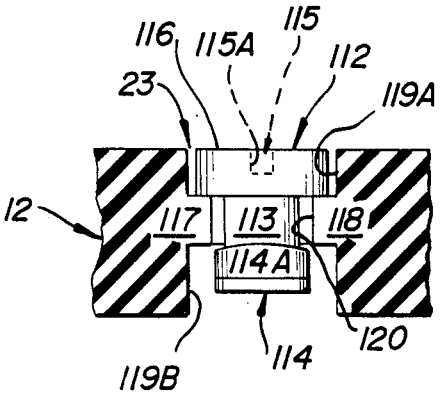
FIGS. 8A and 8B are enlarged side views in partial section of the lug plugs depicted in FIG. 1 after insertion within the line and load terminal access holes of FIGS. 1 and 7A.
Figure 8B:
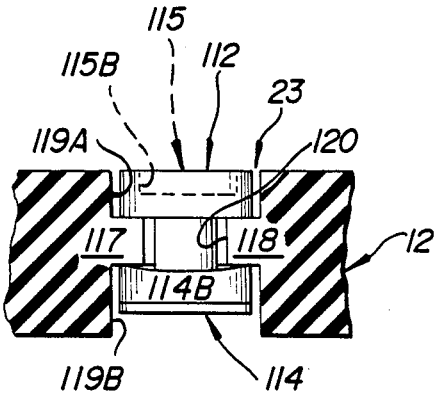

The locking arrangement between the lug plugs 112 and line and load terminal access holes 23 shown earlier in FIG. 1 can be seen by referring now to FIGS. 7A–8B. The line and load terminal access holes 23 are shown in FIG. 7A to consist of a circular hole 119 extending partially within the circuit breaker cover 12. An oval hole 120 is formed within the line and load terminal access hole 23 intermediate the top and bottom parts 119A, 119B (FIG. 8A) of the circular hole 119. Overhanging parts 117, 118 exist on both sides of the line and load lug access holes between the circular and oval shaped holes 119, 120. The lug plug 112 is shown enlarged in FIG. 7B with the tool access slot 115 within the cap 116 defined as having a short edge 115A and a long edge 115B. The oval base 114, joined to the cap 116 by means of the stem 113, has a minor axis 114A and a major axis 114B corresponding in direction to the short and long edges (115A, 115B) of the tool axis slot 115. When the lug plug 112 is first inserted within the line and load access holes 23, the cap 116 and the short edge 115A of the tool access slot 115 are arranged within the top part 119A of the circular hole 119 such that the minor axis 114A of the oval-shaped lug base 114 sits within the bottom part of the circular hole 119 perpendicular to the overhanging parts 117, 118 as indicated. A small screwdriver (not shown) is then inserted within the tool access slot 115 and the lug plug 112 is rotated in the clockwise direction as viewed in FIG. 8A to rotate the lug plug to the position indicated in FIG. 8B. The long edge 115B of the tool access slot 115 assumes the position indicated in FIG. 8B such that the major axis 114B of the oval-shaped base 114 is now perpendicular to the overhanging parts 117, 118 within the ovalshaped hole 120, as indicated. This position effectively traps the major axis 114B under the overhanging parts 117, 118 formed between the top and bottom parts 119A, 119B of the circular hole 119. To remove the lug plug, the screwdriver is again inserted within the tool access slot 115 and the lug plug is rotated in the counterclockwise direction. The lug plug 112 then rotates back to the position shown in FIG. 8A with the minor axis 114A perpendicular to the overhanging parts 117, 118 allowing the lug plug to be removed from the line and load terminal access hole 23.

An integrated circuit breaker has herein been described as containing overcurrent protection along with circuit breaker accessory functions. The integrated circuit breaker accessory units are contained within recesses formed in the integrated circuit breaker cover and are in turn positioned under an accessory cover. Access is readily provided to the accessories through a pair of accessory doors integrally formed within the accessory cover except when the integrated circuit breaker is connected within an electrical enclosure such as a load center or panelboard.

Having thus described my invention, what I claim as new and desire to secure by Letters Patent is:

1. An integrated circuit breaker comprising:

a molded plastic circuit breaker case;

a circuit breaker operating mechanism within said circuit breaker case operatively connected with a pair of separable contacts to separate said contacts upon occurance of an overcurrent condition through said contacts;

a molded plastic cover fastened to said circuit breaker case, said circuit breaker cover including an escutcheon integrally formed therein;

a first recess formed within said circuit breaker cover, on one side of said escutcheon, with at least one circuit breaker accessory nested within said first recess; and an accessory cover fastened to said circuit breaker cover and including a first accessory door hingably arranged over said first recess and said circuit breaker accessory, said accessory cover including a region of a first thickness and a region of reduced thickness said region of reduced thickness thereby defining a flexible hinge for said first accessory door.

2. The integrated circuit breaker of claim 1 including a second recess formed in said circuit breaker cover on a side of said escutcheon opposite said one side with at least one other circuit breaker accessory nested within said second recess.

3. The integrated circuit breaker of claim 2 including a second accessory door arranged over said second recess and said other circuit breaker accessory.

4. The integrated circuit breaker of claim 2 including a third recess formed within said circuit breaker cover at one end of said escutcheon and containing a trip unit printed circuit board under said accessory cover.

5. The integrated circuit breaker of claim 1 including a stepped tab extending from one end of said accessory door.

6. The integrated circuit breaker of claim 5 including a slot formed within said circuit breaker cover at an end of said escutcheon opposite said third recess for receiving said stepped tab.

7. The integrated circuit breaker of claim 5 including a fourth recess formed in said accessory cover on a side of said hinge opposite said accessory door for receiving a rating plug to set the ampere rating of said trip unit printed circuit board.

8. The integrated circuit breaker of claim 5 including an opening through said stepped tab for receiving a fastener to attach said first and second accessory doors to said circuit breaker cover.

9. The integrated circuit breaker of claim 5 including latch means formed on said accessory doors inboard of said stepped tab, and cooperating with an offset formed in said circuit breaker cover to latch said first and second accessory doors to said circuit breaker cover.

10. The circuit breaker of claim 9 wherein said latch means formed in said first and second accessory doors comprises a first groove formed on one surface of said first and second accessory doors opposite a second groove formed on an opposite surface of said accessory door to provide a second region of reduced thickness on said accessory cover.

11. The circuit breaker of claim 10 including an L-shaped piece formed on said latch means whereby a part of said L-shaped piece is trapped under said offset formed in said circuit breaker cover to latch said first and second accessory doors to said circuit breaker cover.

12. An integrated circuit breaker and enclosure comprising:

a molded plastic circuit breaker case supporting line and load terminals at opposite ends thereof;

a circuit breaker operating mechanism within said case;

a pair of separable contacts operably connected with said operating mechanism to separate said contacts upon occurrence of an overcurrent condition through said contacts;

a molded plastic circuit breaker cover fastened to said circuit breaker case and including access openings arranged over said line and load terminals;

a circuit breaker accessory retained within a recess formed in said circuit breaker cover;

an accessory cover attached to said circuit breaker cover and extending over said circuit breaker accessory, said accessory cover including a stepped tab extending from one end and positioned within a slot formed in said circuit breaker cover; and a circuit breaker enclosure including an apertured metal face plate, said circuit breaker being retained within said enclosure behind said face plate, said face plate overlaying said stepped tab to prevent said accessory cover from being opened.

13. The circuit breaker and enclosure of claim 12 further including a pair of accessory doors integrally formed within said accessory cover.

14. The circuit breaker and enclosure of claim 13 including a region of reduced cross-section at one end of said accessory doors for hingeable rotation of said accessory doors.

15. The circuit breaker and enclosure of claim 14 including aperture means through said stepped tabs for fastening said accessory doors to said circuit breaker cover.

16. The circuit breaker and enclosure of claim 14 including latch means formed within said accessory doors inboard said tab for latching said accessory doors to said circuit breaker cover.

17. The circuit breaker and enclosure of claim 16 wherein said latching means comprises a first groove formed in one surface of said accessory doors and a second groove formed on an opposite surface of said accessory doors thereby defining a region of reduced thickness between said first and second opposing surfaces.

18. The circuit breaker and enclosure of claim 17 including:

L-shaped means integrally formed within said accessory doors proximate said first and second grooves; and an offset slot formed within said circuit breaker cover whereby a part of said L-shaped slot is retained within said offset slot for latching said accessory doors to said circuit breaker cover.

19. The integrated circuit breaker and enclosure of claim 12 further including a terminal cover arranged on said circuit breaker cover over one of said line and load terminals.

20. The integrated circuit breaker and enclosure of claim 12 further including a plug within one of said access openings over said line and load terminals.

21. The integrated circuit breaker and enclosure of claim 12 wherein said accessory cover is attached to said circuit breaker cover by trapping a pair of posts integrally formed within a bottom surface of said accessory cover within a corresponding pair of slots formed within a top surface of said circuit breaker cover.

22. The integrated circuit breaker and enclosure of claim 20 wherein one of said access openings comprises a circular and an oval diameter to define an overlap within said access opening intermediate said circular and oval diameters.

23. The integrated circuit breaker and enclosure of claim 22 wherein said terminal plug includes a circular cap joined by a circular stem to an oval base.

24. The integrated circuit breaker and enclosure of claim 23 wherein said circular cap includes a tool access slot formed therein.

25. The integrated circuit breaker and enclosure of claim 24 wherein the short edge of said tool access slot corresponds with the minor axis of said oval base and the long edge of said tool access slot corresponds with the major axis of said oval base.

* * * * *